US005628447A

United States Patent [19]

Ziemek

[11] Patent Number: 5,628,447

[45] Date of Patent: May 13, 1997

[54] METHOD OF MANUFACTURING INTERNALLY GROOVED TUBES FOR HEAT EXCHANGERS

[75] Inventor: Gerhard Ziemek, Langenhagen, Germany

[73] Assignee: Alcatel Kabel AG & Co, Germany

[21] Appl. No.: 619,108

[22] Filed: Mar. 20, 1996

[30] Foreign Application Priority Data

Apr. 26, 1995 [DE] Germany ..... 195 15 336.7

[51] Int. Cl.[6] ..... B21C 37/15

[52] U.S. Cl. ..... 228/147; 228/173.6; 29/890.045; 138/38

[58] Field of Search ..... 228/147, 173.4, 228/173.6, 174; 138/38; 165/183; 29/890.03, 890.045, 890.049, 890.053; 219/59.1

[56] References Cited

U.S. PATENT DOCUMENTS

| | | | |
|---|---|---|---|
| 3,906,605 | 9/1975 | McLain | 228/147 |
| 3,921,883 | 11/1975 | McLain | 228/147 |
| 5,184,674 | 2/1993 | Keyes | 165/184 |
| 5,219,374 | 6/1993 | Keyes | 29/890.049 |
| 5,343,699 | 9/1994 | McAlister | 60/273 |
| 5,494,209 | 2/1996 | Randlett et al. | 228/147 |

*Primary Examiner*—Samuel M. Heinrich

*Attorney, Agent, or Firm*—Ware, Fressola, Van Der Sluys & Adolphson

[57] ABSTRACT

In a method for producing internally grooved tubes for heat exchangers, a smooth metal tape is drawn from a circular supply, a rolling mill provides it with a number of grooves that are parallel to each other and run at an angle of 15° to 45° with respect to the lengthwise direction of the tape, the tape is continuously formed into a tube with a lengthwise slot, and the slot is welded. At least two groups of parallel grooves are rolled into the surface of the metal tape so that the grooves form a herringbone pattern.

3 Claims, 1 Drawing Sheet

METHOD OF MANUFACTURING INTERNALLY GROOVED TUBES FOR HEAT EXCHANGERS

BACKGROUND OF THE INVENTION

1. Technical Field

The invention concerns a method of manufacturing internally grooved tubes for heat exchangers.

Internally grooved and lengthwise welded copper tubes are used in heat exchangers, such as e.g. air-conditioning plants, or where condensation or evaporation is required.

2. Description of the Prior Art

On the coolant side, the grooving produces better heat transfer on the inside of the tube. It is therefore possible to use smaller equipment or less coolant for the same output, or a lower flow speed of the coolant for the same output and type of construction. Such tubes are preferably manufactured by profile rolling a smooth metal tape with a rolling mill, forming the metal band into a tube and welding the lengthwise seam. The welding process may be followed by annealing.

By comparison with seamless tubes used heretofore, the lengthwise welded tubes have advantages with respect to equal wall thickness and thereby more uniform bending characteristics along the entire tube boundary. Since no lubricants are required for rolling the grooves, the internal surfaces of lengthwise welded tubes are free of lubricant residues.

The grooves rolled into the smooth metal tape extend at a 15° to 45° angle from the lengthwise direction of the metal tape. This provides a spin to the medium flowing inside the internally grooved metal tube, which improves the heat transfer.

A lateral force is exerted when a rolling mill produces the angled grooves on the metal tape, which tends to divert the metal tape from its direction of manufacture. The metal tape must therefore have precise lateral guidance.

However, precise guidance cannot always be guaranteed, thus unfavorably affecting the subsequent welding process. The highest demands with regard to guidance of the tape edges in the area of the welding device are particularly placed on the metal tubes in question, with a diameter of about 10 mm and a wall thickness of 0.4 mm. Beyond that, the lateral guidance can cause damage or deformation of the tape edges, which also has a deleterious effect on the quality of the welded seam.

SUMMARY OF THE INVENTION

An object of the present invention is to improve the prior art method in a way so that the additional guidance of the tape edges can be omitted and a lengthwise welded, internally grooved metal tube with a high quality welded seam can be manufactured. The method of the invention forms groups of grooves in a herringbone pattern on the metal tape so that the lateral forces produced by the rolling mill affect both sides equally and therefore cancel each other.

In addition to this advantage, it is now possible to optimize the depth of the grooves and the angle of the grooves with respect to the lengthwise edge in accordance with heat transfer points of view. Another noteworthy advantage is that the different directions of the grooves significantly increase the turbulence in the medium. The edge flows are conducted against each other, which improves the heat transfer.

The invention will be fully understood when reference is made to the following detailed description taken in conjunction with the accompanying drawing.

DETAILED DESCRIPTION OF THE INVENTION

Figure 1:
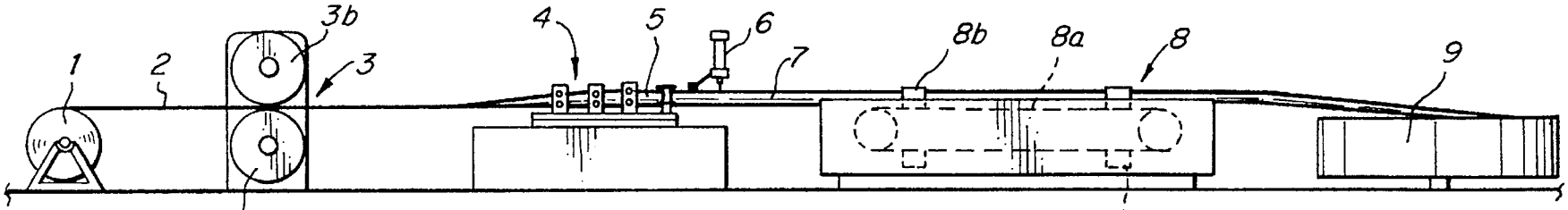
FIG. 1 is a schematic view of a device which is particularly well suited to carry out the method of the invention.

Referring first to FIG. 1, a copper tape or strip 2 of e.g. 30 mm width and 0.4 mm wall thickness is drawn from a storage spool 1 and supplied to a double rolling mill 3. The lower roller **3*a* is smooth and the upper roller 3*b* includes a profile which produces a grooved profile on the upward facing side of the copper tape 2. The profiled copper tape advances to a forming device 4, which forms it into a tube 5 with a lengthwise slot. The lengthwise slot is welded by a welding device 6, preferably an electric arc welding device or a tungsten inert gas welding device. The welded tube 7 is drawn through the production line by a pick-up device 8, preferably a so-called collet chuck puller with several pairs of chucks 8*b* attached to an endless chain 8*a*, and is then transported to a storage container 9**.

Figure 3:
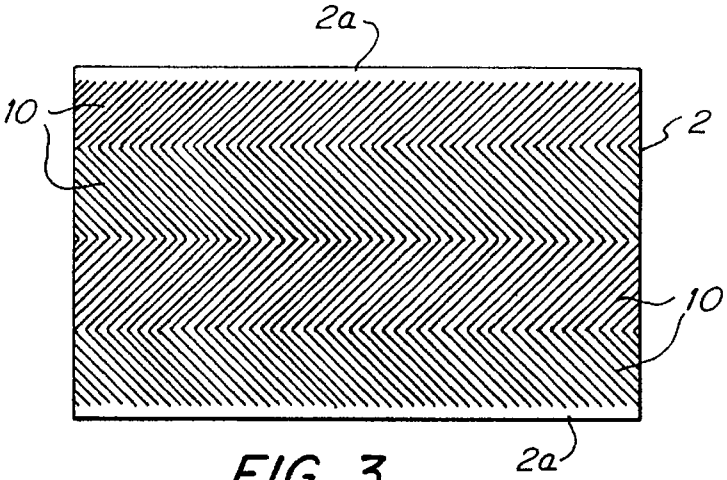
FIGS. 2 and 3 illustrate different patterns of grooves which can be formed on the metal tape.
Figure 2:
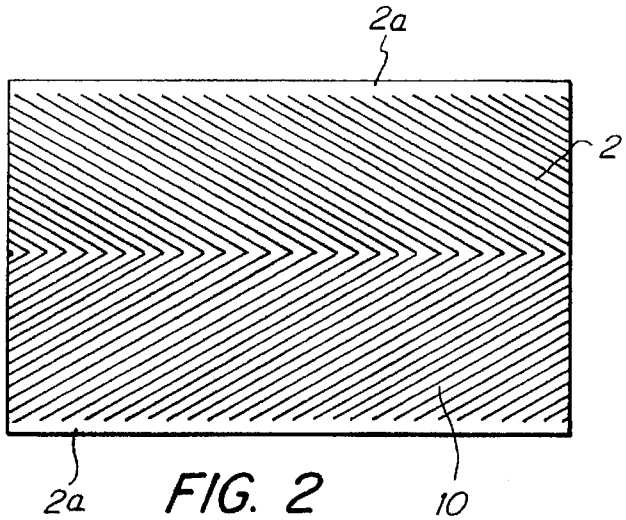

As shown in FIGS. 2 and 3, the profile of the upper roller **3*b* in the invention is configured so that the grooves 10 produced in the copper tape 2 form at least two groups. The grooves in each group run parallel to each other and at an angle with respect to the lengthwise center line of the copper tape 2. The angle is in the range of between 15° to 45° with respect to the lengthwise center line of the copper tape 2 so that they form an angle between 30° and 90° among the grooves of adjacent groups. In FIG. 2, the grooves form a herringbone pattern. In FIG. 3, a double herringbone pattern is rolled into the copper tape 2. The lengthwise edges 2*a* of the copper tape 2 are free of grooves 10** so that smooth areas of at least 1 mm remain, which simplify the welding of the lengthwise edges.

The arrangement of the grooves 10 in the invention allows the copper tape 2 to run straight in the production direction, since no lateral forces are exerted on the copper tape 2 from the profiling by the upper roller **3*b*, or they cancel each other. This considerably increases the quality of the welded seam. Any lateral support of the copper tape 2 between the rolling mill 3 and the forming device 4** can be omitted.

In addition to this advantage, the internally grooved metal tube produced in accordance with the production principle has the advantage that the heat transfer is considerably improved. The improvement is due to the fact that the special arrangement of the grooves 10 allows the flowing edges of the medium being transported inside the tube to oppose each other. This produces a vorticity which improves the heat transfer.

Copper proved to be particularly well suited as tube material, since copper can be machined without chipping, can be satisfactorily welded and has high thermal conductivity.

The welded tubes 7 can be continuously annealed e.g. to improve their bendability, and can subsequently be wound into coils for transportation.

Usually the annealing takes place in so-called hooded furnaces under protective gas, while the length of the tube is stored in the container 9.

The preferred embodiment described above admirably achieves the objects of the invention. However, it will be appreciated that departures can be made by those skilled in the art without departing from the spirit and scope of the invention which is limited only by the following claims.

What is claimed is:

1. A method for producing internally grooved tubes for heat exchangers, the method comprising the steps of:

(a) drawing a smooth metal tape from a circular supply;

(b) forming at least two groups of parallel running grooves into the metal tape so that the grooves extend in the form of a herringbone pattern, the grooves in each group of grooves in the tape are parallel to each other and run at an angle of 15° to 45° with respect to a lengthwise center line of the tape;

(c) forming the metal tape continuously into a tube with a lengthwise slot; and (d) welding the slot.

2. A method as claimed in claim 1, wherein two groups of the parallel running grooves extend from a center of the metal tape toward lengthwise edges of the metal tape, and that the grooves of the two groups form an angle between 30° and 90° among themselves.

3. A method as claimed in claim 1, wherein, during the groove forming step, lengthwise edge areas on the metal tape are left free of grooves for a width of at least 1 mm.

* * * * *